United States Patent [19]

Schwartzkopf

[11] 4,270,458

[45] Jun. 2, 1981

[54] OVERHEAD TRACK ASSEMBLY FOR AMUSEMENT-PARK RIDE

[75] Inventor: Anton Schwartzkopf, Munsterhausen, Fed. Rep. of Germany

[73] Assignee: Firma Anton Schwartzkopf Stahl- und Fahrzeugbeu, Munsterhausen, Fed. Rep. of Germany

[21] Appl. No.: 34,858

[22] Filed: Apr. 30, 1979

[30] Foreign Application Priority Data

Jul. 27, 1978 [DE] Fed. Rep. of Germany ..... 2832990

[51] Int. Cl.[3] ..... B61B 5/02

[52] U.S. Cl. ..... 104/124; 52/127; 104/125; 104/126; 256/24; 256/65; 403/219

[58] Field of Search ..... 52/122, 127; 104/53, 104/63, 64, 69, 124–126; 182/36; 256/24, 25, 65, 69; 294/78 A, 81 R; 403/217, 219

[56] References Cited

U.S. PATENT DOCUMENTS

| | | | |
|---|---|---|---|
| 327,717 | 10/1885 | Phillips | 256/69 |
| 641,118 | 1/1900 | Kelly | 403/217 X |
| 893,495 | 7/1908 | Harvey | 104/124 |
| 2,010,054 | 8/1935 | Brotz et al. | 294/81 R |
| 2,975,536 | 3/1961 | Schindler | 256/24 X |
| 3,837,697 | 9/1974 | Goodrich | 294/78 A X |
| 3,841,223 | 10/1974 | Bertin | 104/124 X |
| 4,029,019 | 6/1977 | Watkins | 104/124 |
| 4,073,478 | 2/1978 | Bermudez | 256/65 X |

FOREIGN PATENT DOCUMENTS

| | | | |
|---|---|---|---|
| 162073 | 10/1953 | Switzerland | 104/124 |
| 373139 | 5/1956 | Switzerland | 403/219 |

*Primary Examiner*—Randolph A. Reese
*Attorney, Agent, or Firm*—Karl F. Ross

[57] ABSTRACT

An overhead track assembly for an amusement-park ride has a plurality of bases adapted to rest on the ground and each supporting an upright post having an upper end forming a support surface and having a pin projecting upwardly from this support surface. A plurality of track sections each include a central hollow beam having one end formed with an upper eye and another end formed with a lower eye, a pair of generally parallel rails flanking the beam and adapted to guide a car longitudinally along the beam, and transverse members interconnecting these rails and the beam rigidly. The track sections are secured to the upper ends of the posts with the pins at these upper ends extending upwardly through the lower eye of one respective beam and through the upper eye of another respective beam. Flat fence panels engage between the posts and bases to hold these posts and bases in place during assembly of the track, and each of the track sections is provided with a zig-zag chain having a ring located directly above the center of gravity of the respective section for easy assembly of the track with a crane.

15 Claims, 7 Drawing Figures

OVERHEAD TRACK ASSEMBLY FOR AMUSEMENT-PARK RIDE

FIELD OF THE INVENTION

The present invention relates to an overhead track assembly for an amusement-park ride. More particularly this invention concerns such an assembly used for a roller-coaster and of a type intended to be assembled and disassembled so that it can be moved from one location to another.

BACKGROUND OF THE INVENTION

An amusement-park ride such as a roller-coaster has at least one car, as for example of the type described in my U.S. Pat. No. 3,855,936, and an endless track along which the car moves. This track is normally formed of a plurality of track sections each having a pair of parallel rails. Upright posts support the ends of these rail sections on supports or bases that rest on the ground.

In nonpermanent installations the track assembly can be completely taken apart into track sections, posts and bases so that the ride can be transported, for example, from one carnival or fair to another.

In a standard system such as shown in German utility model No. 1,917,751 or in German Pat. No. 1,703,917, the rails on which the cars ride themselves are mounted on U-section beams that are connected together by a complex arrangement of transverse and diagonal struts. The track assembly is therefore mounted together by laboriously fitting together these relatively complex elements, some of which are provided with threaded studs and others with holes so that they can be bolted together.

As a rule assembly of such a roller-coaster track is an extremely laborious and frequently dangerous job. The assembly is always very rigid once complete, however prior to completion it frequently is extremely precarious and, even, is occasionally knocked over by high winds. It is normally necessary during installing of each track section that one assembler be at each end where such a track section is to be secured, and that the track section be itself maneuvered into place with a crane operated by a third assembler. Both of the assemblers must normally have good footing so that they can orient the track sections to align with the adjacent structure.

OBJECTS OF THE INVENTION

It is therefore an object of the present invention to provide an improved overhead track assembly for an amusement-park ride.

Another object is to provide such an assembly which can be put together and taken apart in a safe and simple manner by at most two people.

Another object is to provide an amusement-park track assembly which is relatively stable even before it is fully assembled, so that an assembler can climb on it safely and so that the various parts do not have to be temporarily guyed in place during assembly.

SUMMARY OF THE INVENTION

These objects are attained according to the instant invention in a track assembly wherein each of the track sections includes a central hollow beam having one end formed with an upper eye and another end formed with the lower eye, a pair of generally parallel rails flanking this beam and adapted to guide a car longitudinally along the beam, and transverse members interconnecting the rails and the beam rigidly. Each of the posts has at its upper end a support surface and a pin projecting upwardly from the support surface through the lower eye of one of these beams and the upper eye of another beam. Thus once the upright posts are in place each of the track sections need merely be dropped down on top of the pins, thereby automatically positioning it relatively safely, so that the ends of the track sections can be secured together and the eyes can be bolted down on top of the pins.

With the track assembly according to the instant invention it is therefore possible for two assemblers to secure the track sections in place once the posts have all been properly positioned. One of these assemblers operates a crane that lifts each of the track sections up, whereas the other assembler need merely assure that the sections are dropped down over the pins. In fact once one section has been placed on its posts, the second assembler can move along the track as it is assembled, bolting the ends of the track sections together and bolting each end down on the respective pins as the assembly is completed.

According to further features of this invention each of the bases is formed as a heavy metal pallet adapted to rest on the ground and has a respective relatively large upwardly directed and tapered pin that fits into a correspondingly upwardly tapered recess of the respective post. Thus each of the posts can be lowered down in the respective base and is normally adequately held in place by its own weight.

According to a further feature of this invention rigid fence panels are provided which have upright end edges that are provided with formations that engage the bases and posts. Thus between each base and post and the adjacent post there is a rigid fence panel which not only serves as a fence that is invariably required in such arrangements, but that also serves to stabilize the posts before the track sections are in place. To this end the formations that connect the posts, bases, and panels together include an upwardly directed lower pin on each of the bases that engages a lower eye on the respective upright fence-panel edge, and an upwardly directed upper pin above each of the lower eyes on each of the fence panels that engages through an upper eye carried on each of the posts. Thus the bases are positioned and the fence panels are fitted over the lower pins thereof. Thereafter the posts are each fitted over the pin of the respective base and the upper pin of the respective fence panel so as rigidly to lock them into the desired position. Since the normal track assembly follows a closed loop, such an arrangement will provide an extremely stable positioning and holding of the posts even before the track sections are emplaced thereon. The exact positioning ensured by the use of these fence panels further makes it a relatively easy job to fit each of the track sections over the pins of the posts.

In accordance with a further feature of this invention each of the track sections is provided above its center of gravity, when it is in the position it is supposed to assume in use, with an element adapted to be engaged by a crane. This is most easily achieved by mounting a chain with each end secured to the respective end of the main beam of each section and the chain passing zig-zag fashion through guides on the rails of each section. An eye provided in the appropriate location on the chain allows the entire section to be lifted by a crane in such a manner that the section will assume the exact position it should have when installed.

It is noted, in particular with respect to the last-described feature, that these track assemblies are usually custom made, so that at least the posts, fence panels and track sections must fit together in a certain plan. To this end the various parts are normally numbered in sequences so that the assemblers can tell which part goes where. It is of course apparent that some of the track sections will have rails lying in a perfectly horizontal plane, whereas others will have the planes of the rails tipped to the horizontal. In fact in many systems it is possible for the steepest rail to assume an angle of 80° to the horizontal. Some rails will be arcuate corners and will lie in a plane defining an acute angle with the vertical, even where the respective beam extends generally horizontally, as for example at a sharp curve.

According to this invention in all such arrangements the pins on the upper ends of the posts are vertical and the holes through the eyes of the track sections similarly extend vertically, even though the rails may lie at an inclination to the horizontal. The above-described lifting arrangement with an eye located above the center of gravity ensures that once a crane is connected to the ring mounted in the chain and lifts the section by means of this ring, the section can be lowered down directly onto the respective posts and will not have to be manhandled into the proper position.

SPECIFIC DESCRIPTION

Figures 1, 2:
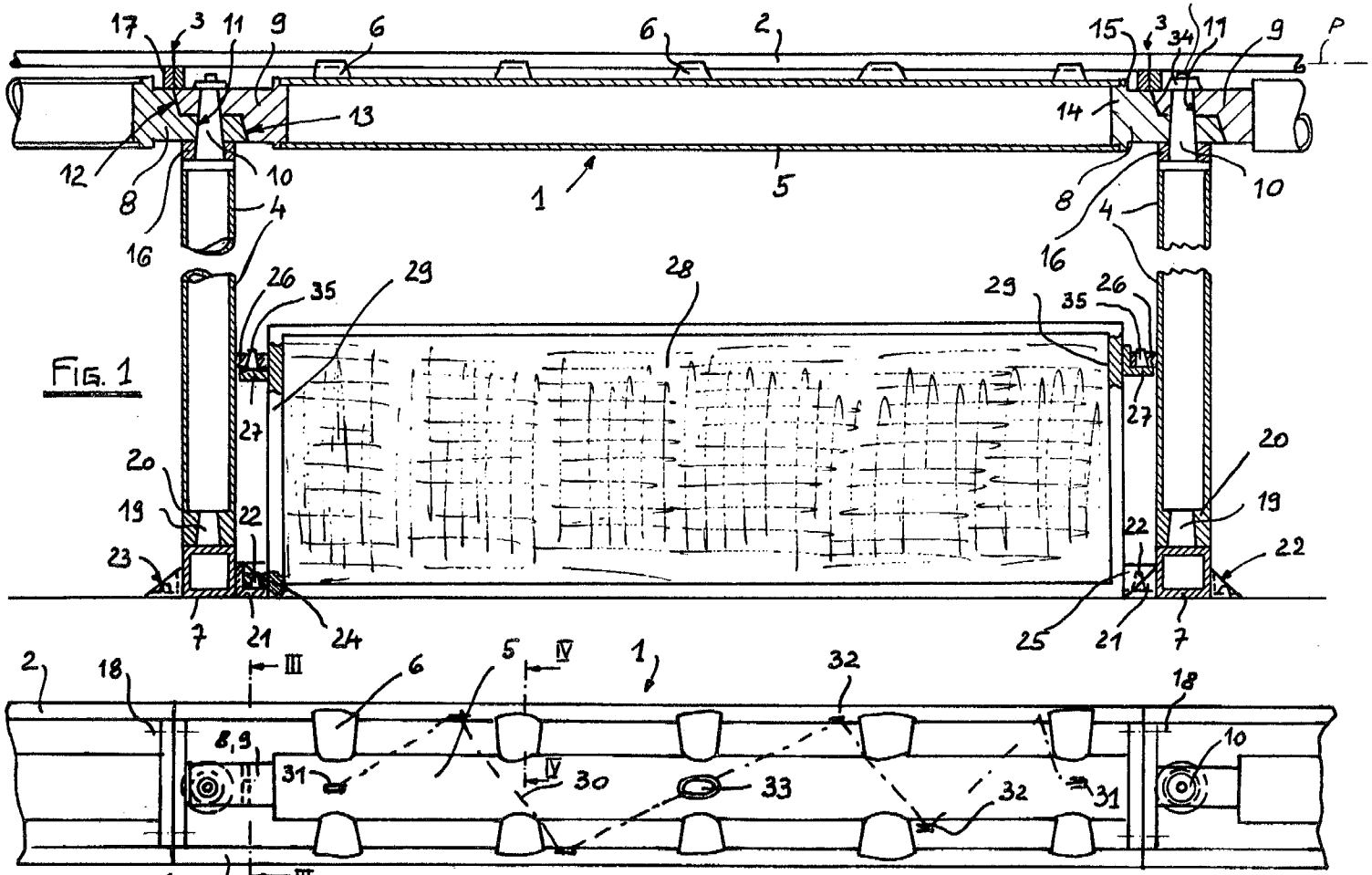
FIG. 1 is a longitudinal section through a portion of a track assembly according to the instant invention.
FIG. 2 is a top view of the track-assembly portion shown in FIG. 1.

As shown in FIGS. 1 and 2 a track assembly according to this invention, intended for use with a roller-coaster car such as described in my U.S. Pat. No. 3,855,936, has a succession of track sections 1 meeting at joints 3 at the top of posts 4. Each of these sections 1 has a pair of parallel tubular rails 2 which in the arrangement of FIGS. 1 and 2 lie in a common horizontal plane P, but which can be tipped both from one end to the other as well as from one side to the other as will be described below. Furthermore each such track section has a cylindrically tubular central beam 5 carrying the rails 2 by means of hollow supports 6. The rails 2 are joined together at the joint 3 by means of a transverse spreader 17, and bolts 18 lock the sections 1 longitudinally together.

Each of the posts 4 is formed as a vertical tubular steel column of cylindrical shape and stands on a respective base 7. At its upper end each of these columns or posts 4 is provided with a respective upwardly extending and tapered pin 10 having a conicity angle of 8°. The beams 5 are also formed as steel tubular cylinders and have at each end an endpiece 14 bearing via a flange 15 on the respective end of the beam 5 and welded permanently thereto. The endpiece 14 at one end is formed with a lower eye 8 and at the other end the endpiece 14 is formed with an upper eye 9. These eyes 8 and 9 together form a vertically tapered hole 11 complementary to the pin 10 of the respective post 4. The lower eye 8 at each joint 3 rests on the respective post 4 via a spacer 16 secured to the post 4. In addition the eyes 8 and 9 have respective inclined end surfaces 13 and 12 each of which is inclined downwardly away from the respective beam 5 at an angle of 10° to the vertical. These surfaces 12 and 13 engage each other snugly when the eyes 8 and 9 are fitted over the pins 10. A screw 37 engages through a washer 34 fixed to the upper side of each of the eyes 9 and is threaded into the pin 10 to hold the two eyes 8 and 9 tightly down at the joint 3.

The posts 4 each have a lower end piece 20 that is welded in place and fits snugly over an upwardly tapered pin 19 extending upwardly from the respective base element 7, here formed as a steel square-section beam adapted to lie directly on the ground. Each of the supports 7 is provided with a pair of fittings 21 at the lower end of the respective post 4 and each having an upwardly extending and tapered pin 22. Directly above each of the pins 22 each of the posts 4 has a respective eye 26 having a vertically throughgoing hole aligned with the underlying pin 22.

A fence panel 28 of rigid construction and adapted to bear advertising or the like has a frame 29 provided at each end at ground level with an outwardly extending fitting 25 having a hole 24 adapted to receive the respective pin 22. Similarly directly above each of the fittings 25 is a projection 27 having an upwardly extending pin 35 engageable through the respective eye 26.

Finally as shown in FIG. 2 each of the beams 5 is provided adjacent each of its ends with an eye 31 connected to one end of a chain 30 also passing through guides or further eyes 32 on the rails 2, so that this chain 31 follows a zig-zag path between the rails 2. At the center of gravity of the respective rail section 1 the chain 30 is provided with a ring 33.

Figure 3:
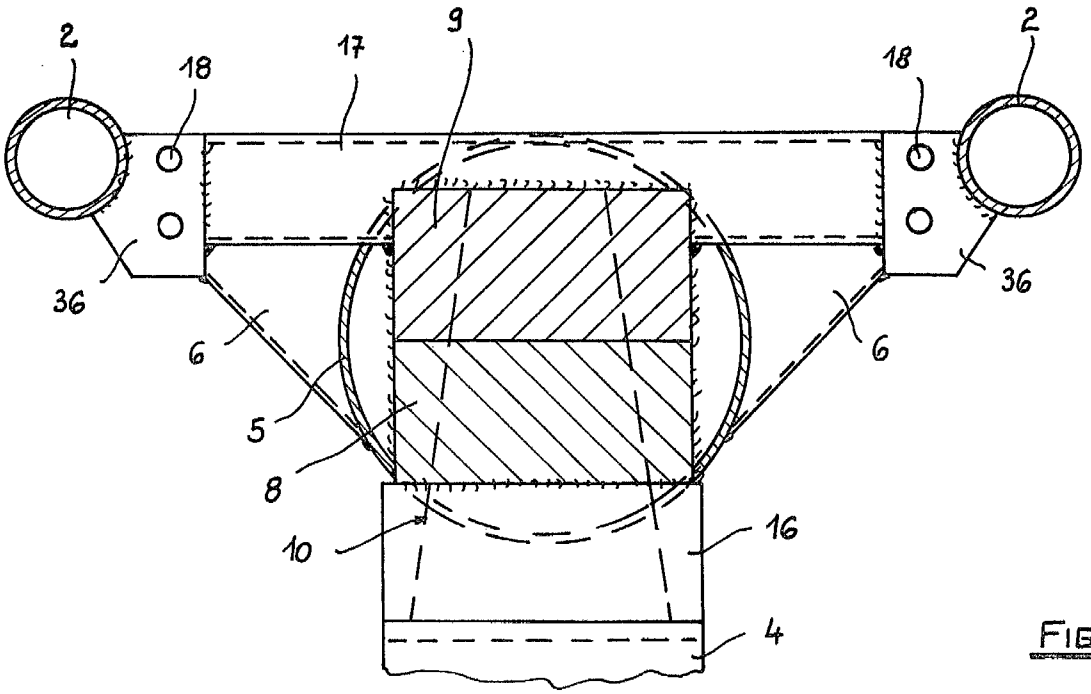
FIGS. 3 and 4 are sections taken respectively along lines III—III and IV—IV of FIG. 2.
Figure 4:
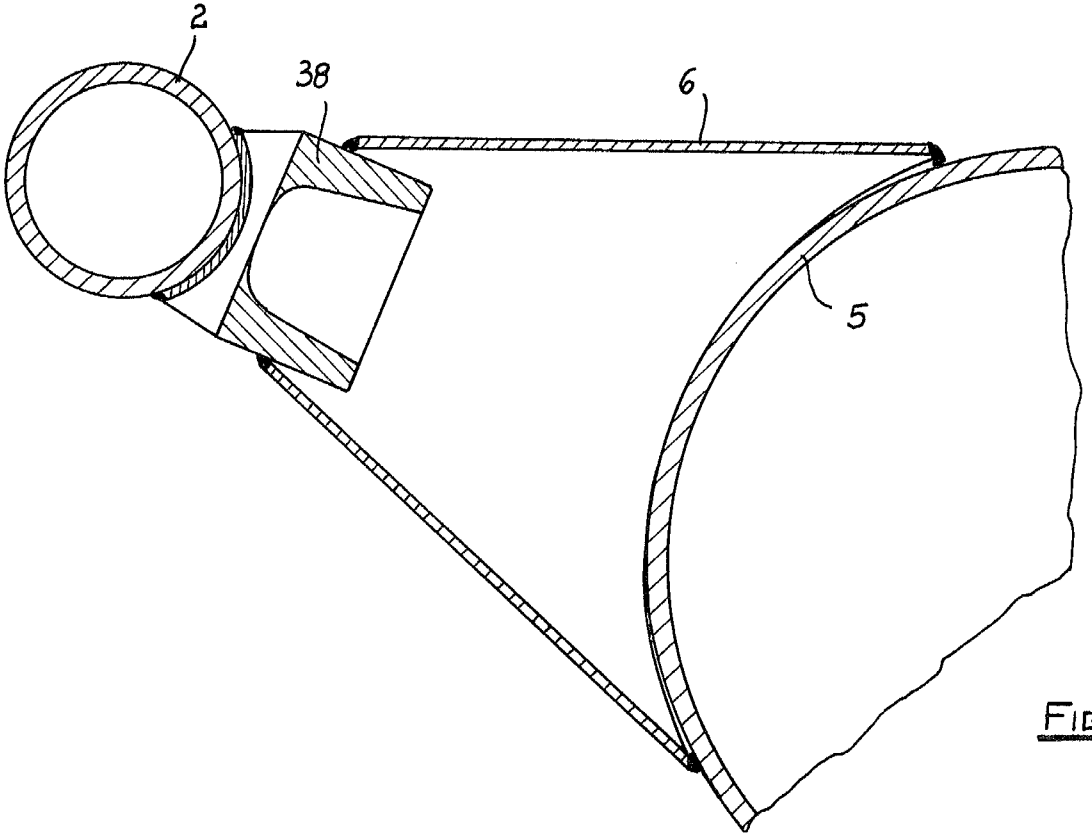

FIGS. 3 and 4 illustrate how welded to each end of each of the tubular struts 17 is a mounting block 36 formed with holes for the bolts 18 and in turn welded to the respective rail 2.

FIG. 4 shows how each of the supports 6 is completely hollow and welded to the respective beam 5. A massive fitting 38 is welded inside the end of each of these frustoconical supports 6 and in turn is welded to the respective rail 2. Such a construction allows rails 2 that have been bent to any desired shape to be mounted on a correspondingly bent beam 5 with ease.

A track constructed in the manner described above can be assembled with ease by means of a light-duty crane and at most one person assisting. To this end the suports 7 are laid out on the ground on the path that the track is to follow. Exact longitudinal spacing is established by fitting the respective fence panels 28 with fittings 25 over the pins 22 of the fittings 21 on the bases 7.

Thereafter the columns or posts 4 are fitted on the supports 7 by engaging the end pieces 20 over the pins 19 and similarly by engaging the fitting 26 over the pins 35 of the fence panel 28. As such a track invariably follows a closed path, fence panels 28 will not be parallel to each other so that the assembly, even in this only partially erected condition, will be completely stable.

Obviously the track is not going to follow a simple perfectly level path, but instead is going to follow various inclined curves. To this end the posts 4 will, of course, be of different lengths, and will be correspondingly numbered so that the assemblers can determine which post 4 goes where.

Thereafter the track sections 1 are laid in place, one after the other. To this end the crane is hooked into the ring 33 of each of the track sections 1. These rings 33 are exactly positioned so that when the respective track section 1 is suspended by its ring 33 the rails 2 will lie at the desired inclination. Being thus properly oriented it is a relatively easy task to lower each of the track sections 1 down over the properly positioned pins 10 of the posts 4, working as shown in FIG. 1 from left to right, so that each time a track section 1 is laid in place the trailing upper eye 9 can be bolted down by means of the screw 37 and the rails 2 can be secured together at the joint 3 by means of bolts 18. As the exact position of the posts 4 is accurately established by the panels 28, fitting together the track in this manner is a relatively easy task.

Figure 5:
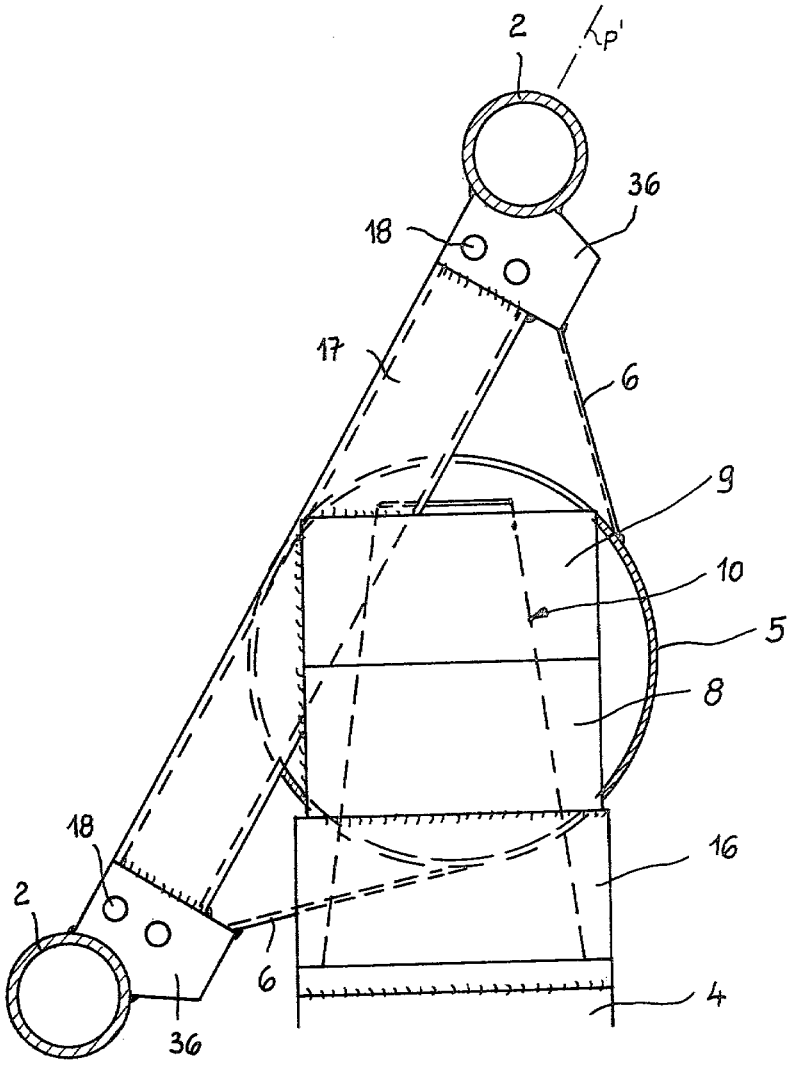
FIG. 5 is a view similar to FIG. 3 showing a tilted track section according to this invention.
Figure 6:
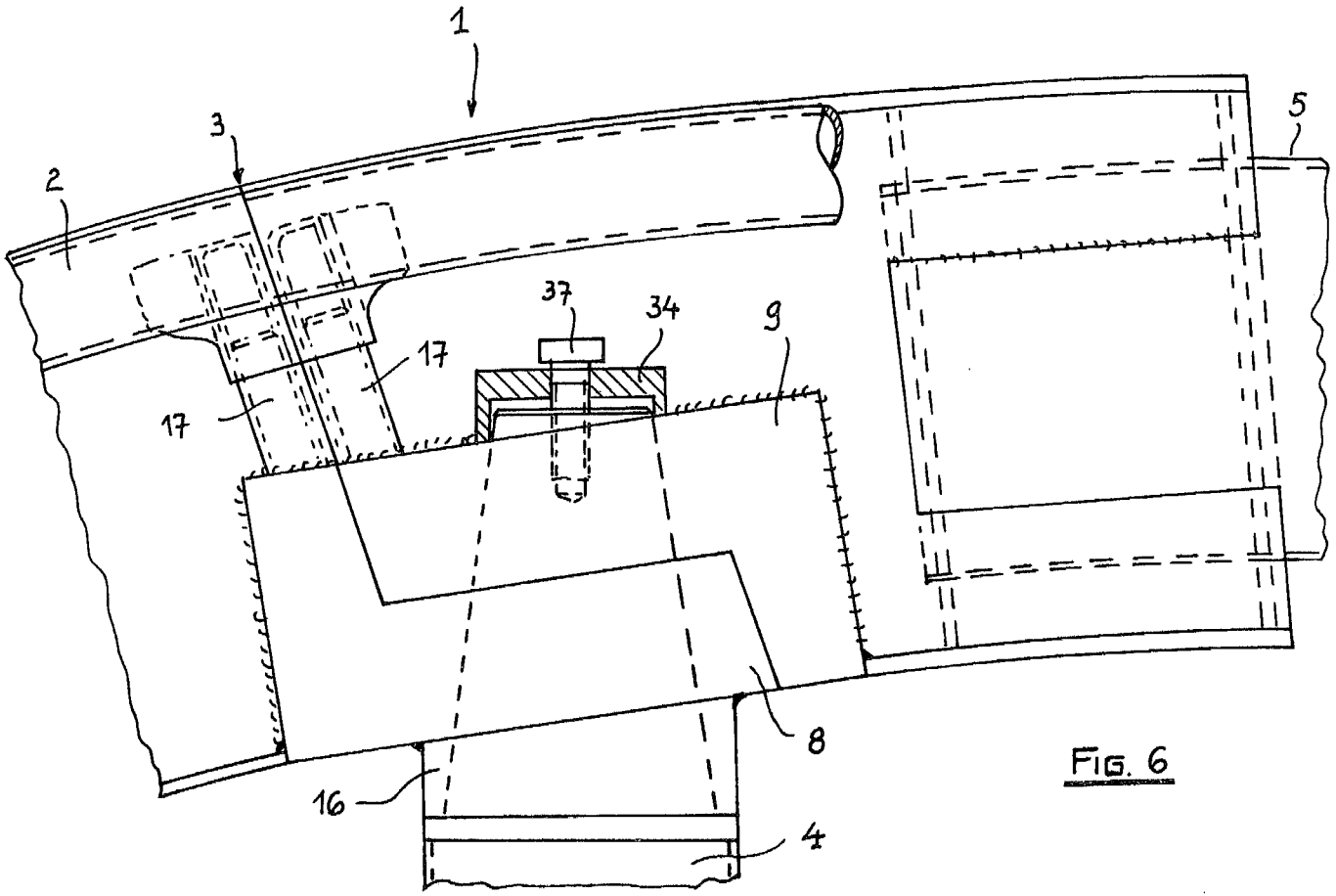
FIG. 6 is a large-scale view of the joint of a tilted portion of a track assembly according to this invention.

FIG. 5 shows how the plane P' of a track section can be inclined greatly to the horizontal, for example at a sharp bend where a car traveling along the track will be moving at high speed. FIG. 6 similarly shows how in a downhill or uphill run the rails 2 and the beam 5 might be arcuate. To this end the spacer 16 fixed to the lower side of the lower eye 8 has opposite faces that are nonparallel to each other so that its lower surface will lie on the horizontal upper surface of the post 4. The cap forming the washer 34 will be similarly constructed so that the screw 37 can bear straight down on its upper surface.

Figure 7:
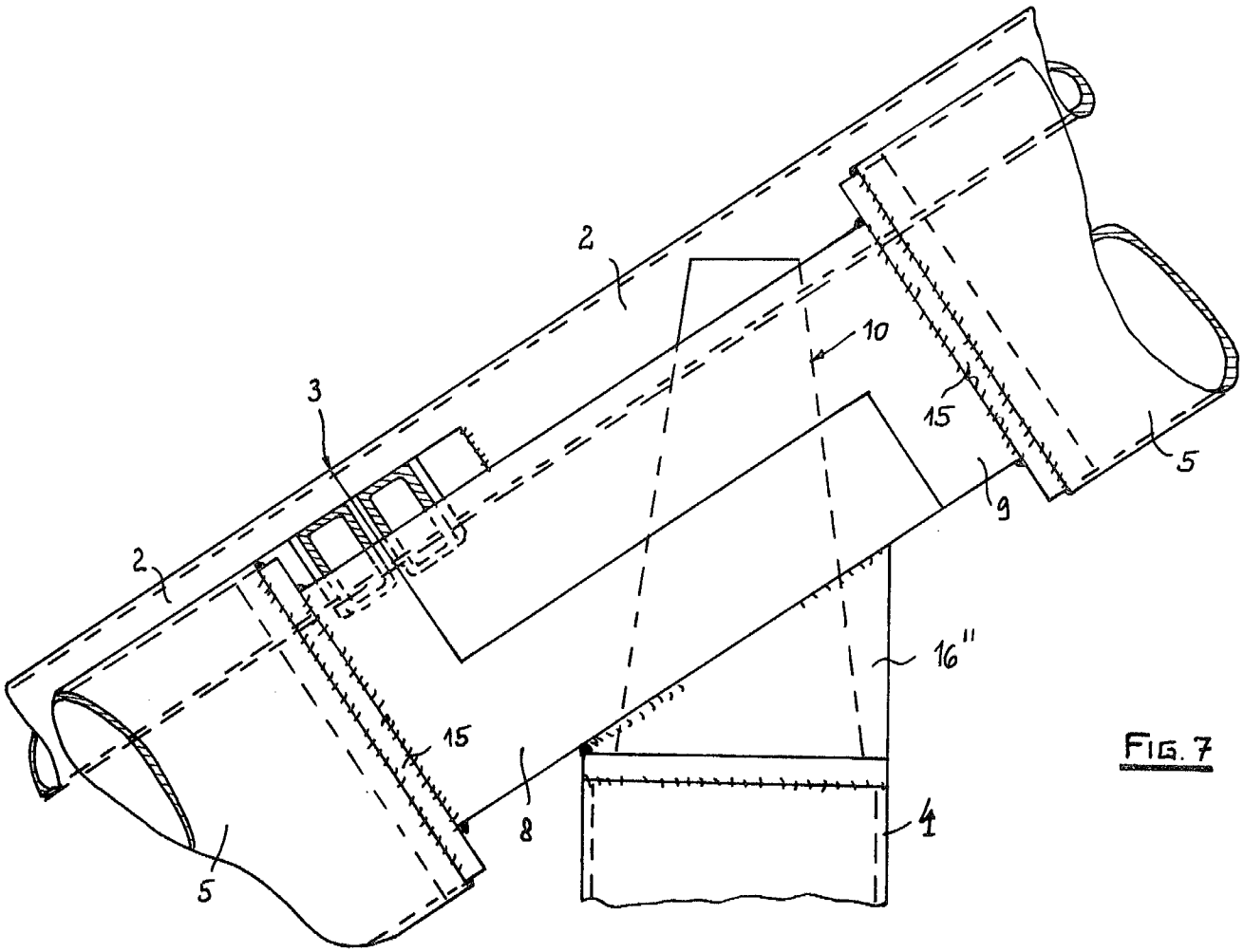
FIG. 7 is a view similar to FIG. 6 of another tilted track portion according to this invention.

In FIG. 7 a substantially more steeply tipped upper surface is provided on a spacer 16'', and the washer 34 is similarly constructed.

In the system according to the instant invention it is therefore possible to erect a relatively complex track in a very simple manner using a light-duty crane operated by one person and a single further person to guide the track sections down onto the pins 10. Once in place on the pins 10 each of the track sections 1 will be relatively stable, so that it is even possible for the assembler to climb along the track. Even a relatively inexperienced pair of workers can quickly and rapidly assemble such a track system assuming, of course, that the various track sections 1 and posts 4 are properly numbered and that the overall ground plan of the system is known.

I claim:

1. A disassemblable overhead track assembly for an amusement-park ride, said assembly comprising:

a plurality of bases adapted to rest on the ground in a longitudinally extending row;

respective upright posts standing on said bases and each having an upper end having a support surface and a pin projecting upwardly therefrom;

respective spacer means extending longitudinally between said posts and secured to same and to the respective bases for releasably connecting said posts longitudinally together and thereby establishing fixed longitudinal spacings between the respective posts and bases in said row;

respective track sections above the respective spacer means and each including a central hollow beam having one end formed with an upper eye and another end formed with a lower eye, a pair of generally parallel rails flanking said beam and adapted to guide a car longitudinally along said beam, and transverse members interconnecting said rails and said beam rigidly; and holding means for releasably securing said sections in a continuous row one behind the other to said upper ends of said posts with each of said pins extending upwardly through the lower eye of one respective beam and through the upper eye of another respective beam.

2. The track assembly defined in claim 1 wherein said pins are each upwardly tapered, said eyes being formed with upwardly tapering throughgoing holes complimentary to said pins.

3. The track assembly defined in claim 1 wherein said eyes each have an end surface lying on a plane inclined to the vertical and flatly engageable with the other track section at the respective pin.

4. The track assembly defined in claim 3 wherein each of said beams is tubular and has at each of its said ends a solid end piece forming the respective eye and end surface.

5. The track assembly defined in claim 1 wherein at least some of said sections have rails lying generally in a plane forming an acute angle with the respective pins.

6. The track assembly defined in claim 1 wherein said transverse members include rigid transverse struts bridging the ends of said rails and provided with formations for securing the struts of adjoining sections together.

7. The track assembly defined in claim 1 wherein said holding means includes respective screws threadedly engaging said pins and respective washers each braced between the respective screw and the respective upper eye.

8. The track assembly defined in claim 1 wherein said transverse members include hollow box-girder struts extending between said beams and said rails.

9. The track assembly defined in claim 1 wherein said pins are tapered at a conicity angle of 8° and said eyes have end surfaces engageable with the adjacent track sections and inclined at 10° to a plane perpendicular to the longitudinal axis of the respective beam.

10. The track assembly defined in claim 1 wherein each of said bases is provided with an upwardly extending and tapered pin, each of said posts having a lower end shaped to fit complementarily over the pin of the respective base.

11. The track assembly defined in claim 10 wherein said spacer means are rigid fence panels having spaced apart upright edges provided with formations each engageable with a respective post and base.

12. The track assembly defined in claim 11 wherein said formations include an upwardly projecting lower pin on each base, a lower eye on each upright edge engageable over the respective lower pin, an upper eye on each post, and an upwardly projecting upper pin on each upright edge engageable through the respective upper eye.

13. The track assembly defined in claim 12 wherein said upper and lower pins are upwardly tapered.

14. The track assembly defined in claim 1, further comprising a suspension element provided above the center of gravity of each track section.

15. The track assembly defined in claim 14 wherein each track section is provided with a chain connected to and guided on the respective rails and beam and attached to the ends of the respective beam, said suspension element being a ring attached to said chain and dimensioned to be hooked by a crane grab.

* * * * *